United States Patent [19]

Ehrlich

[11] Patent Number: 4,593,652

[45] Date of Patent: Jun. 10, 1986

[54] MODULAR TUBE UNIT FOR FLUIDIZED BED BOILERS

[76] Inventor: Saul Ehrlich, 15 Clark St., Brooklyn, N.Y. 11201

[21] Appl. No.: 684,500

[22] Filed: Dec. 21, 1984

[51] Int. Cl.[4] ..... F22B 1/00

[52] U.S. Cl. ..... 122/4 D; 165/104.16

[58] Field of Search ..... 122/4 D; 431/7, 170; 165/104.16

[56] References Cited

U.S. PATENT DOCUMENTS

| | | | |
|---|---|---|---|
| 2,938,712 | 5/1960 | Pellmyr | 165/137 |
| 3,565,022 | 2/1971 | Bishop | 122/4 D X |
| 4,096,909 | 6/1978 | Jukkola | 122/4 D X |
| 4,273,073 | 6/1981 | Robinson | 122/4 D |

*Primary Examiner*—Edward G. Favors

*Attorney, Agent, or Firm*—Lackenbach Siegel Marzullo Presta & Aronson

[57] ABSTRACT

A modular in bed tube unit including a hatch cover bolted over a hatch-opening in the front wall of a fluidized bed boiler. The modular unit also includes a feed fluid manifold, a steam manifold, and a plurality of in-bed tubes connected at one end to the feed fluid manifold and that are connected to and extend through the hatch cover in the fluidized bed of the combustion chamber and extend from the bed back through the hatch cover to the steam manifold. Bolted connecting flanges, between the feed fluid pipe of the boiler system and between the steam manifold and the steam pipe of the boiler system can be quickly disconnected. The entire unit can be quickly removed and replaced when the in-bed tubes become deteriorated. For water wall boilers, the tubes of the front water wall are bent inwards at the hatch opening to allow positioning of the in-bed tubes. The modular unit can be adapted to multiple boiler units.

12 Claims, 6 Drawing Figures

MODULAR TUBE UNIT FOR FLUIDIZED BED BOILERS

BACKGROUND OF THE INVENTION

This invention relates generally to the replacement of in-bed boiler tubes for fluidized bed boilers and in particular to modular in-bed steam tube units for fluidized bed boilers.

Fluidized bed construction (FBC) is a practical, efficient way to burn coal and other fuels in an environmentally acceptable manner. In addition, fluidized bed boilers are able to utilize a wide variety of coals including high sulfur and high-ash coals and still obtain optimum results. As much as 98% of the sulfur in the coal can be absorbed and changed to a dry calcium sulfate, which is not harmful to the environment. As a result, FBC technology, which has been known for many years, has recently become a growing force in many commercial operations.

A coal-fired fluidized bed boiler burns particles of coal in a bed of limestone that is suspended in air that is forced upwards from the bottom and causes the limestone particles to percolate upwards like a liquid through the bed. As the velocity of air is increased, the limestone becomes suspended and the bed resembles a boiling fluid.

Steam boiler tubes immersed in the bubbling bed of fuel and limestone deteriorate rapidly. Tube replacement requires extensive downtime in order to cut out the deteriorated tubes, generally by burning out the tubes and installing new tubes by welding. This is a laborious and time-consuming process which includes extending the down-time of the boiler unit undergoing repairs.

Patents relating to tube bundles extending into a heated chamber and housing connections to a manifold or heater outside the chamber are as follows:

| Inventor | U.S. Pat. No. | Granted |
|---|---|---|
| Johanson | 1,820,979 | Sept. 1, 1931 |
| Epstein et al. | 1,873,638 | Aug. 23, 1932 |
| Mahoney | 1,918,608 | July 18, 1933 |
| Lavender | 2,006,836 | July 2, 1935 |
| Van Seggern | 2,016,759 | Oct. 8, 1935 |
| Hofmeister | 2,660,410 | Nov. 24, 1953 |
| Pellmyr | 2,938,712 | May 31, 1960 |
| Nevins | 3,244,225 | Apr. 5, 1966 |
| Henderson | 3,554,706 | Jan. 12, 1971 |

A patent relating to a fluidized bed boiler is U.S. Pat. No. 4,240,377 issued to Johnson Dec. 23, 1980. A review of these patents has not disclosed the features of the embodiments of the disclosure discussed hereinbelow in the opinion of the applicant. For this reason, no detailed discussion of these patents is set forth here.

SUMMARY OF THE INVENTION

Accordingly, it is an object of the present invention to provide a modular system for easily replacing deteriorated steam tubes in the bed of a fluidized bed boiler.

It is another object of the present invention to provide a replaceable modular unit for a fluidized bed boiler that includes a hatch wall adapted to be removably bolted to the boiler, boiler tubes extending through and welded to the hatch, inlet and outlet manifolds, and fast release flanges connected to the inlet and outlet manifolds and the inlet and outlet steam lines from the boiler feed pump and the steam drum respectively.

It is yet another object of the present invention to provide a quick release and mounting modular system for in-bed boiler tubes, fluidized bed boiler.

It is still another object of the present invention to reduce boiler downtime in fluidized bed boilers by providing a modular in-bed steam tube system that allows fast removal and replacement of deteriorated steam boiler tubes.

In order to achieve the above objects, as well as others that will become apparent hereafter, a modular in-bed boiler tube system for fluidized bed boilers is provided that includes at least one fluidized bed boiler forming a combination chamber containing the fluidized bed and having a front wall forming an opening to the fluidized bed; a source of boiler feed fluid; a feed fluid line proximate to front wall and connected to the source of feed fluid; a steam line proximate to the front wall; a modular tube unit mounted to the front wall at the opening, positioned in the fluidized bed, and connected to the feed fluid line and to the steam line, the tube unit being adapted to pass the feed fluid from the feed fluid pipe into the fluidized bed for conversion to steam, and for passing the steam from the fluidized bed to the steam line; a mounting apparatus adapted to quickly attach and detach the tube unit to and from the front wall of the boiler; a first connecting device positioned between the tube unit and the feed fluid line adapted to attach and detach the tube unit to and from the feed fluid line; and a second connecting apparatus positioned between the tube unit and the steam line for quickly attaching and detaching the tube unit to and from the steam line. The tube unit includes an inlet feed fluid manifold connected to the feed fluid line, an outlet steam manifold connected to the steam line, a cover member capable of being removably attached to the front wall around the periphery of the opening in the front wall, and a plurality of in-bed tubes having inlet and outlet portions positioned in the fluidized bed, the in-bed tubes being connected at the inlet portions to the feed fluid manifold and at the outlet portions to the steam manifold and extending through and sealably mounted to the cover member at the inlet and outlet portions. The boiler includes a rear wall opposed to the front wall and opposed side walls and further includes a plurality of front, rear, and side walls respectively, the front water-wall tubes, bending inwardly into the combustion chamber to the rear wall at the opening at the front wall forming a water wall tube pocket at the fluidized bed, the in-bed tubes being positioned in the pocket. The in-bed tubes slope downwardly and inwardly from the inlet portions, form an angle spaced closely from the rear water wall tubes, and slope downwardly and outwardly to the outlet portions. The cover member is preferably removably secured to the front wall of the boiler by bolts. Pairs of flanges removably connected by bolts secure connecting pipes between the feed fluid manifold and the feed fluid pipe and between the steam manifold and the steam pipe.

The system can be applied to double boilers or multiple boilers by mounting separate modular tube units to openings at the front wall of each separate boiler. Shut-off valves are appropriately positioned between each manifold and pipe so that each unit can be isolated during the shut-down mode.

DESCRIPTION OF THE PREFERRED EMBODIMENTS

Figure 1:
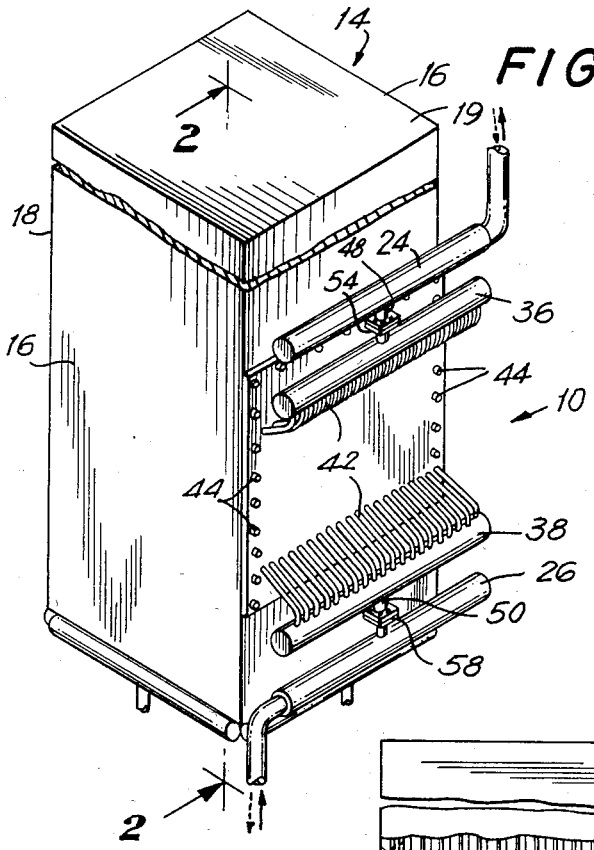
FIG. 1 is a perspective view of a single unit fluidized bed boiler with the modular boiler tube unit.

Reference is now made specifically to the drawings in which identical or similar parts are designated by the same reference numerals throughout.

FIGS. 1–4 illustrates a modular in-bed boiler tube system 10 mounted onto the front wall 12 of a fluidized bed combustion boiler 14. Boiler 14 has a pair of opposed side walls 16, a rear wall 18 opposed to front wall 12, and top and bottom walls 19 and 20, respectively, that enclose combustion chamber 22. A hatch opening 23 that is part of system 10 is formed by front wall 12 at the lower-mid-area of boiler 14 spaced from both top wall 19 and bottom wall 20, and generally between side walls 16.

A boiler feed water/steam inlet line 26 is fed either from the boiler drum downcover, an economizer section, or directly from the boiler feed pumps (which are not shown as they are conventional and do not form a part of the invention). The selection of the type of system to be employed depends on the pressure and temperature of the steam to be produced. As shown in FIGS. 1–4, inlet line 26 is referably disposed at the bottom front area of boiler 14. The preferred flow, as is the usual pattern for the water/steam line, is shown by solid arrows going upwards in FIGS. 1,2 and 4. It is noted, however, that inlet feed can be disposed at the top of the front wall of boiler 14, with this latter feed being indicated in phantom arrows going downwards in FIGS. 1, 2 and 4. A plurality of general vertical boiler water wall tubes 28, which are positioned around the inner surfaces of side walls 16 and rear wall 18. Water wall tubes 28' extend vertically between hatch opening 23 and top wall 19 and opening 23 and bottom wall 20 and bend inwards into combustion chamber 22 from front wall 12 at the top of opening 23 and to rear wall 18 (with space provided between tubes 28 for the passage of gas), and extend vertically downwards spaced closely from water wall tubes 28 at rear wall 18, and then bend horizontally outwards to front wall 12 at the bottom of opening 23 where they extend vertically downwards again so as to form a tube pocket 34. The bottom horizontal extension of front water wall tubes 28' is spaced slightly below fluidized boiler bed 30, which extends generally above the bottom of bed 32 as indicated by phantom line 32 in FIG. 2.

Tube pocket 34 is generally disposed in fluidized bed 30 ut is also generally disposed away from bed 30 so that tubes 28' are not subject to the deterioration that can accompany direct exposure to the fluidized bed.

Figure 5:
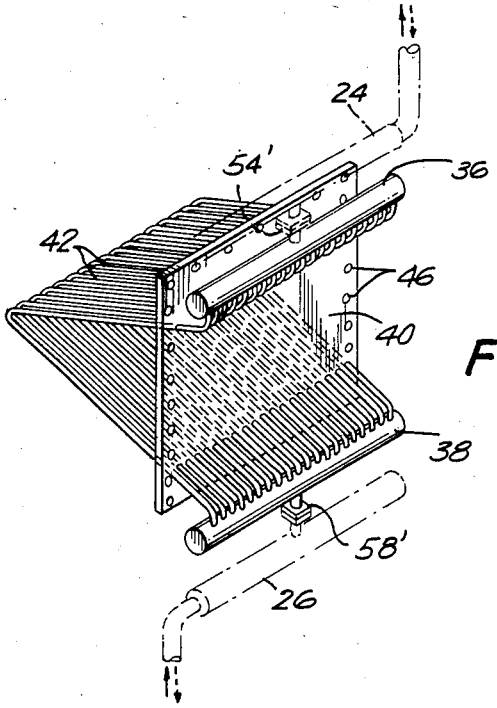
FIG. 5 is a perspective view of the boiler-tube modular unit.

In-bed tube modular system 10, shown in isolation in FIG. 5, includes a rectangular hatch cover 40 that is sealably and removably attached to front wall 12 around the periphery, or rim area, of hatch opening 23 in a manner to be explained; an inlet side boiler feed water/steam manifold 38, which extends horizontally above feed water/steam inlet line 26; an outlet side boiler steam manifold 36, which extends horizontally below steam outlet line 24; and a plurality of in-bed boiler tubes 42 that are connected at each one of their ends to inlet side manifold and slope inwardly and upwardly at each of one of their ends through hatch cover 40 into fluidized boiler bed 30 to a position slightly spaced from front water wall tubes 38' and rear wall 18, then bend at an acute angle 37 and slope outwardly and upwardly from acute angle 37 from fluidized bed 30 through hatch cover 40 for connection at each of their other ends to outlet side manifold 36. In-bed tubes 42 are disposed in fluidized bed 30 in tube pocket 34 of front water wall tubes 28'.

Figure 2:
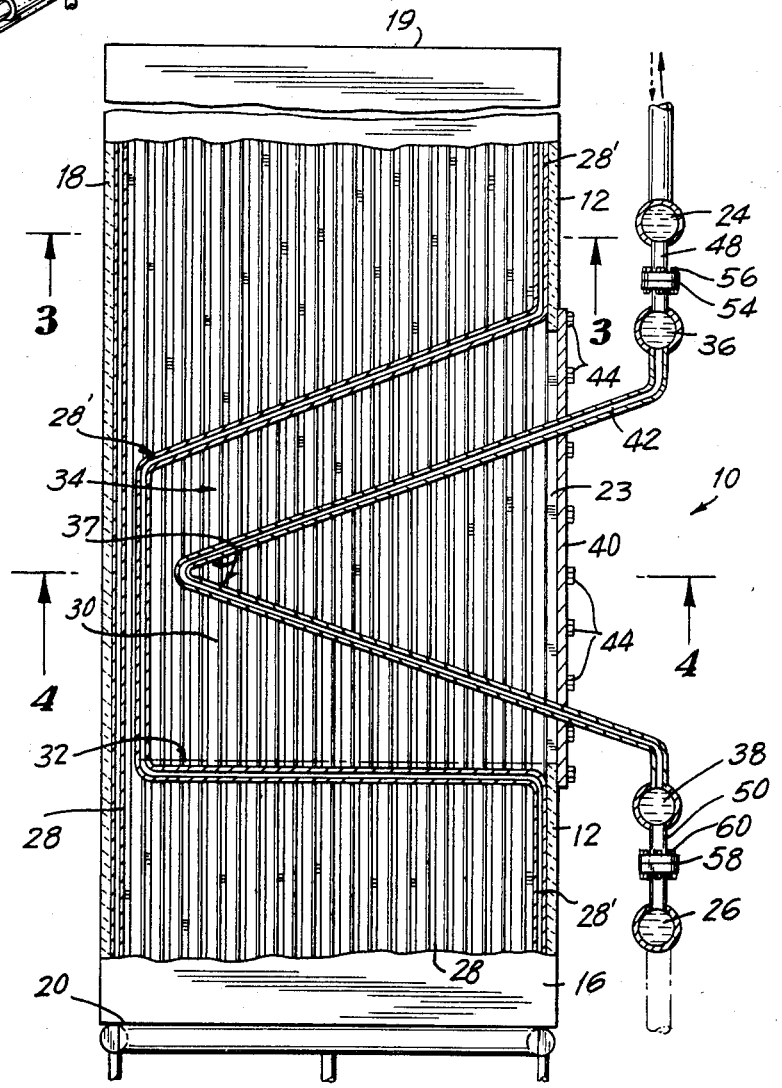
FIG. 2 is a view taken through plane 2—2 in FIG. 1.
Figure 3:
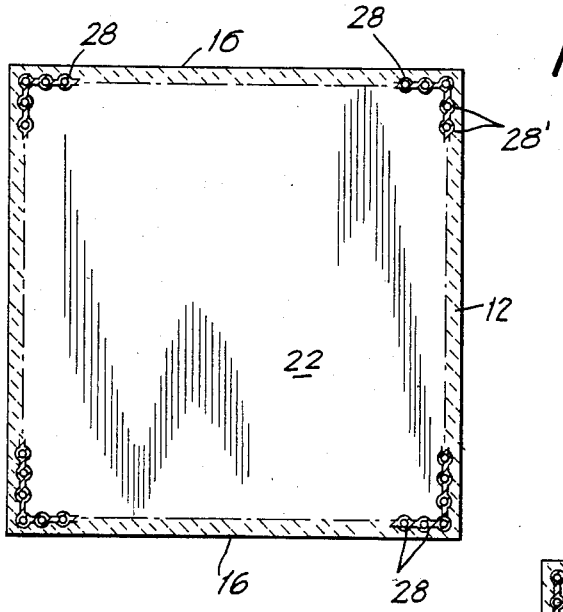
FIG. 3 is a view taken through line 3—3 in FIG. 2.
Figure 4:
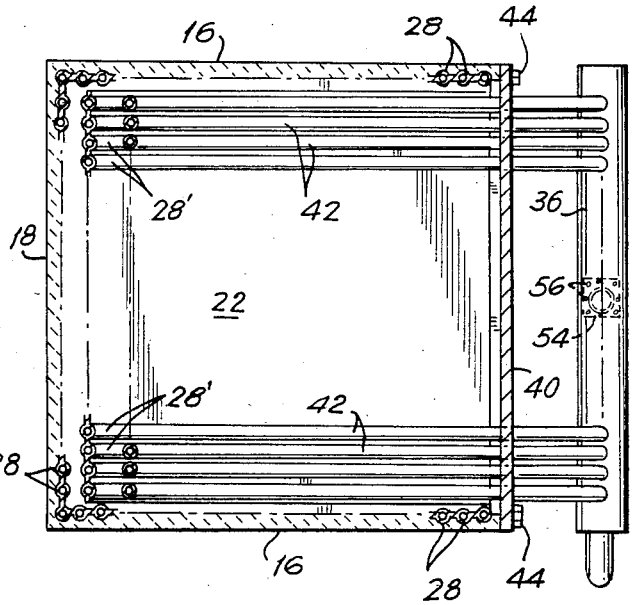
FIG. 4 is a view taken through line 4—4 in FIG. 2.

In-bed tubes 42 are sealably mounted by welding to hatch cover 40 at both tube inlet and outlet portions that pass through hatch cover 40 from inlet manifold 38 and to outlet manifold 36, respectively. Hatch cover 40 is sealably and removably secured to front wall 12 of boiler 14 by a plurality of bolts 44 seen in FIGS. 1 and 2. Bolt holes 46 are seen deposed along the edges of hatch cover 40 in FIG. 5. Bolts 44 extend into front wall 12 around the periphery of hatch cover 40. Hatch cover 40 can be quickly assembled to or disassembled from front wall 12 by removal or placement of bolts 44. As seen in FIGS. 1, 2, and 5, an inlet connecting pipe 50 connects to mid-area of inlet feed manifold 38 with feed water/steam line 26; and an outlet connecting pipe 48 connects the mid-area of outlet steam manifold with outlet steam manifold 36. Inlet connecting pipe 50 has a pair of connecting flanges 58 secured by a plurality of flange connector bolts 60. Outlet connecting pipe 48 has a pair of connecting flanges 54 secured by a plurality flange connector bolts 54. Connecting pipes 48 and 50 can be quickly disconnected by removal of bolts 56 and 58. Likewise, connecting pipes 48 and 50 can be quickly connected by mounting of bolts 56 and 58. The bottom flange 54' of flange pair 48 and the top flange 58' of flange pair 58 are shown connected to the portion of inlet connecting pipe 48 that extends upwardly from inlet feed manifold 36 and to the portion of outlet connecting pipe 50 that extends downwardly from outlet steam manifold 38.

When in-bed boiler tubes 42 become deteriorated, boiler 14 is shut down and bolts 44 removed so as to free hatch cover 40, and flange connector bolts 56 and 60 are likewise removed so as to separate flange connectors 54 and 58. Thus, modular system 10 is freed from its mounted disposition with boiler 14. Module 10, including cover 40, in-bed tubes 42, and inlet feed manifold 36, and outlet feed manifold 38 with extending portions of inlet and outlet connecting pipes 48 and 50, is removed. A replacement module 10 is then mounted with boiler 10 by securing hatch cover 40 to front wall 12 with bolts 44 and connecting flange pairs 54 and 58 with bolts 56 and 60. This entire operation can be accomplished in a short time.

Figure 6:
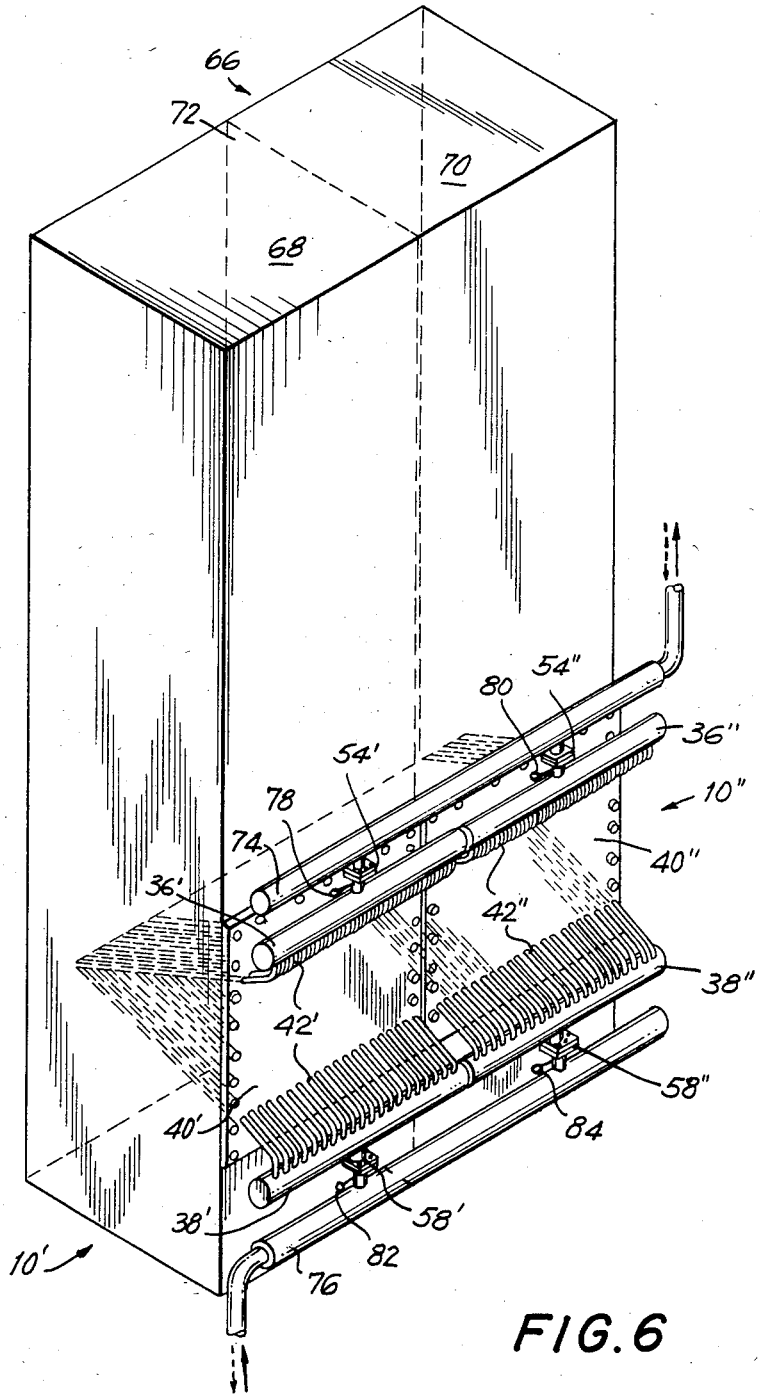
FIG. 6 is a perspective view of a double boiler unit with a pair of separate in-bed boiler tube modules.

Modular system 10 can be applied to small industrial boilers or to large utility boilers. FIG. 6 shows a double boiler unit 66 forming two separate adjoining boiler units, or combustion chambers, 68 and 70 separated by a common water wall 72. Either combustion chamber 68 or 70 may be shut down while the adjacent unit remains in operation.

A pair of separate modular systems 10' and 10'' having in-bed boiler tubes 42' and 42'', respectively, are each secured to units 68 and 70, respectively, by bolting of hatch covers 40' and 40'' respectively and upper flange connectors 54' and 54'' and lower flange connectors 58' and 58'', respectively, for connection to boiler feed manifolds 38' and 38'' and steam manifolds 36' and 36'', respectively, which in turn are connected to feed water/steam inlet line 76 and steam outlet line 74 of units 68 and 70, respectively. Shut-off valves 78 and 80 are mounted to the connecting lines upstream of upper flange connectors 54' and 54''; and shut-off valves 82 and 84 are mounted to the connecting line downstream of flange connectors 58' and 58'', respectively, thus allowing isolation of either unit 68 and 70 independently of the other unit to allow for quick replacement of deteriorated in-bed boiler tubes 42' or 42'' by replacement of modular units 10' or 10''. Shut-off valves 78 and 80 are shown for the purpose of exposition to be hand-operated valves. In fact, as is known in the art, such valves are generally automatically operated type valves, and the description herein of the shut-off mode of units 68 or 70 is sufficient to instruct those familiar with the art to apply to automated boiler systems.

The embodiment of this invention particularly disclosed and described hereinabove is presented merely as an example of the invention. Other embodiment, forms, and modifications of the invention coming within the proper scope and spirit of the appended claims will, of course, readily suggest themselves to those skilled in the art.

What is claimed is:

1. An in-bed tube system for a fluidized bed boiler, comprising, in combination, at least one fluidized-bed boiler forming a combustion chamber containing said fluidized bed and having a front wall forming an opening to said fluidized bed, a source of boiler feed fluid, a feed fluid line proximate to said front wall and connected to said source of feed fluid, a steam line proximate to said front wall, tube means mounted to said front wall at said opening, positioned in said fluidized bed, and connected to said feed fluid line and to said steam line, said tube means being for passing said feed fluid from said feed fluid pipes into said fluidized bed for conversion to steam, and for passing said steam from said fluidized bed to said steam line, mounting means for quickly attaching and detaching said tube means to and from said front wall of said boiler, first connecting means positioned between said tube means and said feed fluid line for quickly attaching and detaching said tube means to and from said feed fluid line, connecting means positioned between said tube means and said steam line for quickly attaching and detaching said tube means to and from said steam line;

said tube means including an inlet feed fluid manifold connected to said feed fluid line, an outlet steam manifold connected to said steam line, a cover member capable of being removably attached to said front wall around the periphery of said opening, and a plurality of in-bed tubes having inlet and outlet portions positioned in said fluidized bed, said in-bed tubes being connected at said inlet portions to said inlet feed fluid manifold and at said outlet portions to said outlet steam manifold and extending through and sealably mounted to said cover member at said inlet and outlet portions; and said boiler including a rear wall opposed to said front wall and opposed side walls and further including a plurality of front, rear and side wall tubes positioned in said combustion chamber at said front, rear and side walls, respectively; said front wall-/water wall tubes bending inwardly into said combustion chamber to said rear wall at said opening at said front wall forming a water wall tube pocket at said fluidized bed, and said in-bed tubes being positioned in said water wall tube pocket;

whereby said tube means can be quickly assembled and disassembled from said boiler.

2. A system according to claim 1, wherein said in-bed tubes slope downwardly and inwardly from said outlet portions, form an angle spaced from said rear water wall tubes, and slope downwardly and outwardly to said inlet portions.

3. A system according to claim 2, wherein said mounting means includes a plurality of bolts removably securing said cover member to said front wall at the periphery of said opening.

4. A system according to claim 3, wherein said first connecting means includes a first connecting pipe positioned between said feed fluid manifold and said feed fluid pipe, a first pair of connecting flanges positioned at said second connecting pipe, and a plurality of bolts positioned around the rims of said first pair of flanges.

5. A system according to claim 4, wherein said first connecting means includes a second connecting pipe positioned between said steam manifold and said steam pipe, a second pair of connecting flanges positioned at said second connecting pipe, and a plurality of bolts positioned around the rim of said flanges.

6. A system according to claim 5, wherein said at least one boiler is a first boiler, and further including a second boiler adjoining said first boiler, one of said side walls being a common side wall forming in part first and second conbustion chambers, said first and second boilers having first and second front walls forming first and second openings respectively to said first and second combustion beds respectively; said tube means being first and second tube means mounted to said first and second front walls respectively at said first and second openings, each said first and second tube means including said feed fluid manifold and said steam manifold, said first and second connecting means and said first and second connecting pipes and said first and second pairs of connecting flanges being positioned between each said feed fluid manifold and each said feed fluid pipe and between each said steam manifold and each said steam pipe, and further including inlet side shut-off valves positioned at said first connecting pipes upstream of said first pairs of connecting flanges, and outlet side shut-off valves positioned at said second connecting pipes downstream of said second pairs of connecting flanges.

7. An in-bed tube system for a fluidized bed boiler, comprising, in combination, at least one fluidized bed boiler forming a combustion chamber containing said fluidized bed and having a front wall forming an opening to said fluidized bed, a source of boiler feed fluid, a feed fluid line proximate to said front wall and connected to said source of feed fluid, a steam line proximate to said front wall, a plurality of tube means representing an entire bundle for said at least one boiler mounted to said front wall at said opening, and positioned in said fluidized bed, adapted to be connected to said feed fluid line and to said steam line, said tube means being for passing said feed fluid from said feed fluid pipes into said fluidized bed for conversion to steam, and for passing said steam from said fluidized bed to said steam line, mounting means for quickly attaching and detaching said plurality of tube means to and from said front wall of said boiler, first manifold means for connection to said plurality of tube means, and to said feed fluid line;

first connecting means positioned between said first manifold means and said feed fluid line for quickly attaching and detaching said plurality of tube means to and from said feed fluid line;

second manifold means for connection to said plurality of tube means, and to said steam line;

second connecting means poditioned between said second manifold means and said steam line for quickly attaching and detaching said plurality of tube means to and from said steam line, said boiler including a rear wall opposed to said front wall and opposed side walls and further including a plurality of front, rear, and side water wall tubes positioned in said combustion chamber at said front, rear and side walls, resepctively, said front wall water wall tubes bending inwardly into said combustion chamber to said rear wall at said opening at said front wall forming a water wall tube pocket at said fluidized bed, and said in-bed tubes being positioned in said pocket;

whereby said bundle having a plurality of tube means can be quickly assembled to and dissembled from said boiler by the coupling or decoupling of both said first and second manifold means.

8. A system according to claim 7, wherein said in-bed tubes slope downwardly and inwardly from said outlet portions, form an angle spaced from said rear water wall tubes, and slope downwardly and outwardly to said inlet portions.

9. A system according to claim 8, wherein said mounting means includes a plurality of bolts removably securing said cover member to said front wall at the periphery of said opening.

10. A system according to claim 9, wherein said first connecting means includes a first connecting pipe positioned between said feed fluid manifold and said feed fluid pipe, a first pair of connecting flanges positioned at said second connecting pipe, and a plurality of bolts positioned around the rims of said first pair of flanges.

11. A system according to claim 10, wherein said first connecting means includes a second connecting pipe positioned between said steam manifold and said steam pipe, a second pair of connecting flanges positioned at said second connecting pipe, and a plurality of bolts positioned around the rim of said flanges.

12. A system according to claim: 1, wherein said at least one boiler is a first boiler, and further including a second boiler adjoining said first boiler, one of said side walls being a common side wall forming in part first and second combustion chambers, said first and second boilers having first and second front walls forming first and second openings respectively to said first and second combustion beds respectively; said tube means being first and second tube means mounted to said first and second front walls respectively at said first and second openings, each said first and second tube means including said feed fluid manifold and said steam manifold, said first and second connecting means and said first and second connecting pipes and said first and second pairs of connecting flanges being positioned between each said feed fluid manifold and each said feed fluid pipe and between each said steam manifold and each said steam pipe, and further including inlet side shut-off valves positioned at said first connecting pipes upsteam of said first pairs of connecting flanges, and outlet side shut-off valves positioned at said second connecting pipes downstream of said second pairs of connecting flanges.

* * * * *